United States Patent [19]

Nakajima et al.

[11] 4,067,215

[45] Jan. 10, 1978

[54] METHOD FOR PRODUCING STEEL PLATE FROM A HOT ROLLED STEEL COIL

[75] Inventors: Tsuyoshi Nakajima; Toshio Shigesawa, both of Kisarazu, Japan

[73] Assignee: Nippon Steel Corporation, Tokyo, Japan

[21] Appl. No.: 653,960

[22] Filed: Jan. 30, 1976

Related U.S. Application Data

[63] Continuation-in-part of Ser. No. 611,805, Sept. 9, 1975, abandoned, which is a continuation of Ser. No. 336,458, Feb. 28, 1973, abandoned, which is a continuation of Ser. No. 71,649, Sept. 14, 1970, abandoned.

[30] Foreign Application Priority Data

Sept. 13, 1969 Japan ..... 44-73777

[51] Int. Cl.[2] ..... B21D 1/02

[52] U.S. Cl. ..... 72/40; 72/129; 72/160

[58] Field of Search ..... 72/40, 129, 160, 163, 72/164, 165

[56] References Cited

U.S. PATENT DOCUMENTS

| | | | |
|---|---|---|---|
| 2,190,986 | 2/1940 | Hudson | 72/160 |
| 2,327,103 | 8/1943 | Gude | 72/160 |
| 2,963,070 | 12/1960 | Maust | 72/165 |
| 3,020,624 | 2/1962 | Menster | 72/40 |
| 3,156,288 | 11/1964 | Lawson | 72/165 |
| 3,180,122 | 4/1965 | Evans et al. | 72/160 |
| 3,253,445 | 5/1966 | Franek | 72/234 |
| 3,312,094 | 4/1967 | Birkle | 72/165 |

FOREIGN PATENT DOCUMENTS

| | | | |
|---|---|---|---|
| 841,065 | 7/1960 | United Kingdom | 72/163 |

*Primary Examiner*—Lowell A. Larson

*Attorney, Agent, or Firm*—Toren, McGeady and Stanger

[57] ABSTRACT

Hot rolled steel plate having an absolute warp value of less than 20mm for a 3m length of cut plate and not subjected to deterioration of mechanical properties, is formed by subjecting steel strip from a hot rolled coil to a strong cold leveling to provide a maximum surface strain $\epsilon$ max within the range of 0.60% $\leqq \epsilon$ max $\leqq$ 3.0%. The steel strip may then be subjected to a light cold leveling for slowly diminishing the surface strain. Further, after the straightening or leveling operation the plates are inspected, coated with a rust preventative, marked with identifying indicia and directed to a piling device. The inventive and novel method and apparatus of the present invention for manufacturing thick steel plate from hot rolled coil, which has not been previously successful, is extraordinarily excellent in amelioration of productivity compared with any of the conventional thick steel plate producing methods.

16 Claims, 31 Drawing Figures

| MARK | STEEL GRADE | PLATE SIZE | YIELD STRENGTH |
|---|---|---|---|
| ● | SS 41 | 4.5 x 1524 x 3048 | 25.7 Kg/mm² |
| ○ | X-46 | 16.0 x 1250 x 3000 | 35.7 Kg/mm² |
| × | X-42 | 12.7 x 1520 x 3048 | 32.4 Kg/mm² |
| △ | SS 41 | 6.0 x 1524 x 3048 | 26.0 Kg/mm² |
| □ | SS 41 | 6.0 x 1250 x 3000 | 26.5 Kg/mm² |

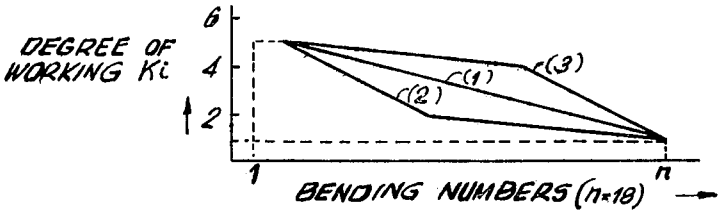
FIG. 8a
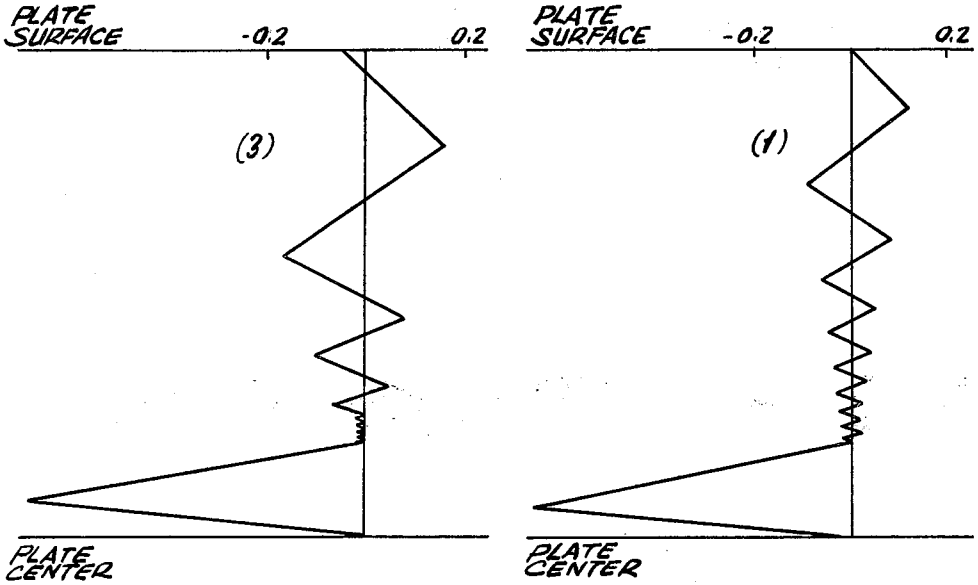
FIG. 8b
FIG. 8c
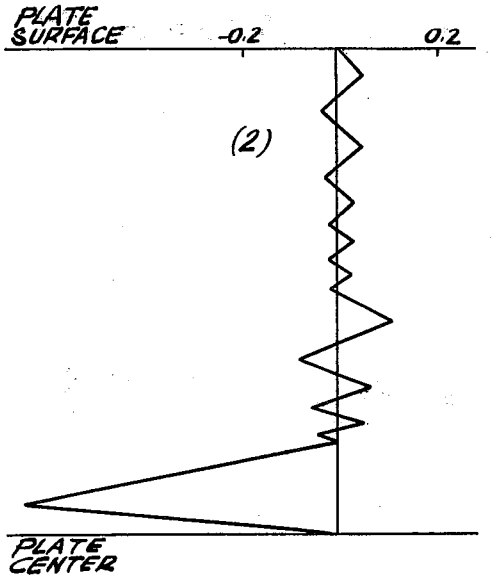
FIG. 8d

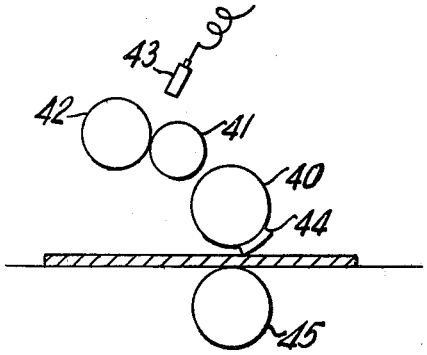
FIG. 18
EXAMPLE OF MARKING
SS 41
12.0 x 1230 x 6000
HEAT NO. M-66110
COIL NO. 72-1145
FIG. 19
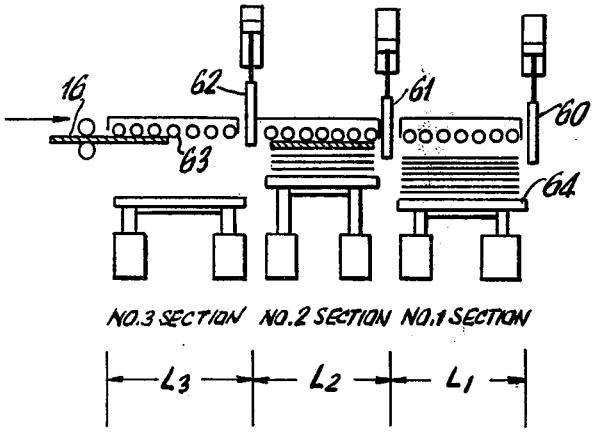
FIG. 20
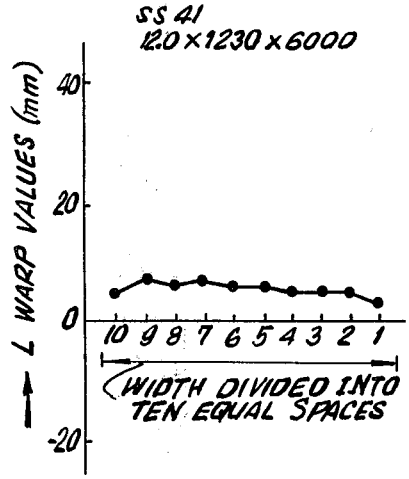
FIG. 21
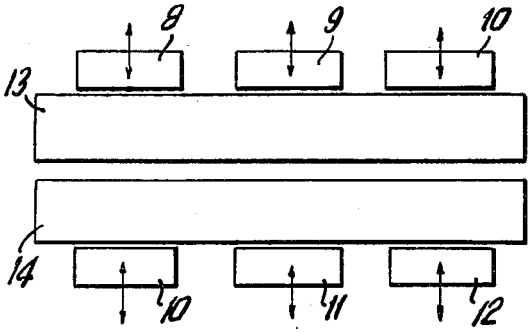
FIG. 22
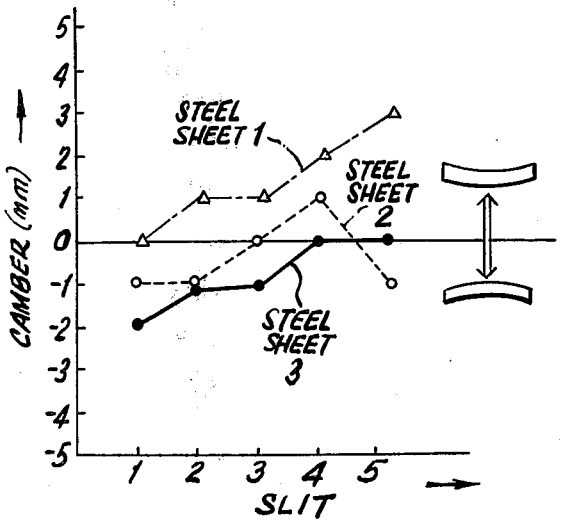
FIG. 23

METHOD FOR PRODUCING STEEL PLATE FROM A HOT ROLLED STEEL COIL

The present application is a continuation-in-part of application Ser. No. 611,805 filed Sept. 9, 1975, now abandoned, which, in turn was a continuation of application Ser. No. 336,458 filed Feb. 28, 1973, now abandoned, which, in turn, was a continuation of Ser. No. 71649, filed Sept. 14, 1970, now abandoned.

SUMMARY OF THE INVENTION

The present invention is directed to a method and apparatus for producing thick steel plates from a hot rolled coil, which plates are comparable or superior to conventionally produced steel plates and, more particularly, it concerns a straightening or leveling operation where cold leveling is used and is effected preferably in two series arranged steps, the first being a strong cold leveling and the second a light cold leveling.

The present invention is directed to the industrial production of steel plates having a thickness of between 4.5 mm $\neq$ 16 mm in an economical, efficient and continuous manner. After the steel strip has been leveled and cut into plates, it is provided with a rust preventative layer and is marked with its specifications, dimensions or the like.

In the past attempts have been made to produce hot rolled steel plates comparable to conventional steel plate products from from a hot rolled coil ("steel plates" or "plates" as used herein mean large plates sheared from a coil), however, no satisfactory method has been obtained. That is, in thick steel plates conventionally made from a coil, a very large warp is produced in the cut plates ("cut plates" mean small plates cut out from a steel plate) when cutting, particularly when the cutting is done by shear cutting and gas cutting; so that the use of these steel plates is limited, and they cannot be used for the same purposes as those of conventional steel plate products.

While numerous studies and development programs have been run to come up with a method for producing steel plates from a hot rolled coil, these efforts have ended in failure. The problem in conventional steel plates from a coil is that a very large warp is produced in the cut plates because of the working effected on the plate during cutting, such as gas cutting. The extent of the warp in cut plates is such that they can not be used for the same purposes as conventional steel plate.

However, it is indisputable, from the viewpoint of productive efficiency, that the production of steel plate such as in a range of 4.5 to 16 mm from hot rolled coil in a continuous manner is far superior to conventional mill production steel plate. Accordingly, tremendous efforts have been made to achieve a successful method of producing steel plate from hot rolled coils.

In plates produced from hot rolled coils, the surface scale layer is thinner than in conventional plate mill products, and, furthermore, the scale partially peels off in the unwinding and leveling operations resulting in an earlier generation of rust on the plates. In conventional steel plates there is often a need to mark specifications, dimensions, delivery addresses and similar information on the plate. However, clear marking on the plate surface is difficult because the surface scale partially peels off and the surface condition is unstable so that rust will be formed and causing the obliteration of the marking. In many studies it has been appreciated that the marking of steel plate produced from hot rolled steel coil can be superior to that afforded in the production of conventional plate and, as a result, continuing efforts have been made to develop an effective method of producing steel plate from hot rolled steel coil.

Generally speaking, the scale formed on the steel surface of a coil in a hot rolling operation has a certain degree of rust prevention, however, the scale will be peeled off by a cold leveling step causing an early formation of rust and making it difficult to provide clear markings on the plate surface. As a result, the plate formed is not useful in applications which require identification markings.

The markings referred to include production specifications, sizes, identification of the producer, production numbers, shipping date and destination, dealers names, trademarks and the like. Recently considerable attention has been directed to the method of marking plate for improving the production yield. With properly marked plate it is easy to distinguish the front and back sides and also the length and width dimensions of the plate and thus, it makes for easy handling and selection of plates, or it helps to improve the product yield and the quality in working of steel plates.

A primary object of the present invention is to provide a method of and apparatus for producing steel plates from a hot rolled coil strip having 4.5 mm to 16 mm thickness, which plates are equal to or better than plates formed by a conventional plate will. In other words, it is a primary object of the present invention to produce steel plates from a hot rolled coil where the plates have an excellent form and quality even though gas cutting is used to divide the steel plates cut into plates.

In the conventional method of producing hot rolled steel plate from a hot rolled coil, the combined use of a skin pass mill with a leveler or the single use of an individual leveler has been practiced and it was possible to produce steel plates without warp. But, since the object of using skin pass mill and or leveler was to flatten the shape of steel plate as a whole, the compression stress or tensile stress remained locally in the steel plate when the straightening process has been done in order to flatten the plate, and the balance of the stress was merely maintained in the plate. Therefore, when the steel plate is cut to form cut plates, the balance of the internal stress therein was lost, and large warp necessarily occurred in the cut plates. This is why the straightening ordinarily conceivable, that is, the straightening applied in order to flatten steel plate as a whole, is not effective in preventing the warping of a cut plate. It had been thought that subjecting the coiled strip to a straightening operation stronger than that effected for flattening the strip would cause the deterioration of the mechanical properties of the strip, accordingly, it was thought to be impractical to use such a strong straightening procedure.

The inventors of the present invention, after extensive studies concerning the relationship between the warp of cut plates and leveling conditions, have confirmed that, when the steel strip uncoiled from a hot rolled coil was subjected to a special cold leveling of a strength that had been considered impractical, not only was a remarkable decrease in the warp of cut plates noticed after an ordinary light or weak cold leveling was effected, but also that the risk of causing deterioration in mechanical properties of the plate, which had been anticipated, did not result.

Using the present invention has resulted in an increase in productivity of steel plates about two times as compared with that of conventional plate manufacturing procedures. The shape, dimensions and precision of cutting of the plates is improved, surface flaws and crowns are reduced and the plate is particularly suitable for use as frame material in automobiles and as steel plate for use in shipbuilding and tank construction.

Accordingly, the present invention stems from the unobvious use of both a strong and light cold leveling operation in straightening coiled strip so that it can effectively be cut to form plate material.

In accordance with the present invention, hot rolled plates are produced from hot rolled coiled strip material produced in a continuous hot rolling mill, by subjecting a steel strip obtained from the hot rolled steel coil to a cold roller leveling to provide a maximum surface strain $\epsilon$ max within the range of $0.60\% \leqq \epsilon \max \leqq 3.0\%$ for reducing residual stress in the central portion of the steel strip, and then diminishing surface strain $\epsilon$ to the range of the elastic limit strain of the steel for reducing the residual stress in the surface portion of the steel, said strip being cut at least after providing the maximum surface strain $\epsilon$ max in order to produce steel plates.

In a preferred form of the invention a second leveling step is employed, in which the leveling force is less than that in the first leveling step, whereby the surface strain $\epsilon$ is suitably reduced from $\leqq 2.0\%$, to near the elastic limit strain of the steel. By way of further explanation, if $\epsilon \max = 3.0\%$, in the primary stage, then at the start of the second stage $\epsilon$ will be less than 3.0% and preferably $\leqq 2.0\%$. If the primary leveling is applied to produce $\epsilon \max = 0.6\%$ then the second leveling will produce an $\epsilon$ of less than 0.6%.

Surface strain (given the symbol $\epsilon$) is an absolute value of the bending strain on the steel surface, and as used herein the strain is given to the steel surface by simple alternate bending of the steel in a roller leveler. The maximum surface strain ($\epsilon$ max) is the absolute value of the maximum bending strain given to the steel as it passes through the roller leveling. Preferably, the step of cutting the plates from the strip material takes place between the two leveling steps.

The apparatus used in carrying out the invention includes an uncoiler, a cold leveler for imparting strong leveling forces to the coiled strip for decreasing the residual stress in the central portion of the strip, a second cold leveler for applying considerably lower leveling forces as compared to the first cold leveler for decreasing the residual stress in the surface portion of the steel plate, and a cutting device preferably located between the two levelers.

Also, it has been found that the above described method is not always sufficient for making the distribution of the residual stress throughout the width direction of the steel plate uniform, as a result, a camber is rarely generated in the cut plate when the steel plate is subjected to slitting process.

Therefore, the other object of the present invention is to provide a method for preventing the camber from being generated in the cut plate.

The characteristic feature of the above method lies in the provision of a roll crown control device in at least one of the roller leveler sets so that the roll crown is so controlled by the roll crown control device that the relationship between the surface strain $\epsilon_e$ of the steel strip or plate at the side end edge thereof and the surface strain $\epsilon_c$ of the steel strip or plate at the center of the width thereof satisfy the following equation, thereby making the distribution of the residual stress in the steel plate in the width direction thereof more uniform so as to prevent the camber from being generated in the cut plate:

$$\epsilon_e = \epsilon_c(1 + \alpha\lambda)$$

where:

$\epsilon_c$ = surface strain (%) at the center of the width of the steel strip or plate, $\epsilon_e$ = surface strain (%) at the side end edge of the steel strip or plate, $\alpha = 0.03 - 0.10$ $\lambda$ = steepness rate (%) of the shape of the steel strip ( (−) sign of $\lambda$ in case of the greater elongation existing at the side end edge of the strip than that at the center thereof, (+) sign of $\lambda$ in case of the greater elongation existing at the center than that at the side end edge).

The term "hot rolled coil" as used herein includes hot rolled coils as produced in a continuous hot rolling mill but also includes such coils to which a surface treatment has been applied such as a dry or wet descaling treatment.

The various features of novelty which characterize the invention are pointed out with particularity in the claims annexed to and forming a part of this disclosure. For a better understanding of the invention, its operating advantages and specific objects attained by its use, reference should be had to the accompanying drawing and descriptive matter in which there are illustrated and described preferred embodiments of the invention.

BRIEF DESCRIPTION OF THE DRAWINGS

FIGS. 8*a*, 8*b*, 8*c* and 8*d* are graphs showing the relation between the distribution of residual stress and leveling conditions;

FIG. 18 is a schematic showing of a marking device 13 in FIG. 14 used in one embodiment of the present invention;

FIG. 19 is a graphic representation of the marking provided by the device in FIG. 18;

FIG. 20 is a schematic showing of a product piler 14 in FIG. 14 used in one embodiment of the present invention;

FIG. 21 is a graph representing the measured values of the L-warp in accordance with one example of cut plates formed in accordance with the present invention;

FIG. 22 is a schematic view showing the arrangement of the heavy leveler rolls when the generation of the camber is to be avoided; and FIG. 23 is a diagram showing the camber of cut plates after slitting the steel plate.

DETAILED DESCRIPTION OF THE INVENTION

Figure 1:
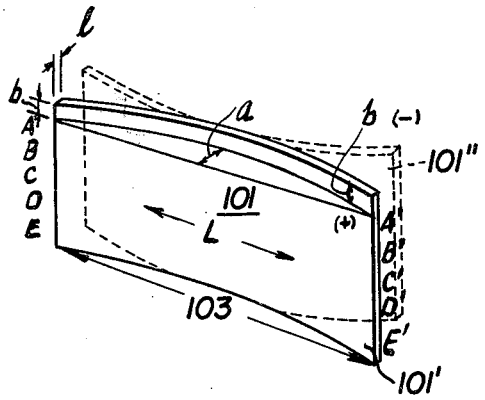
FIG. 1 is a perspective view indicating the procedure for measuring the L-warp of a steel plate and a cut plate as formed in the present invention.

In FIG. 1 the manner of measuring the degree of L-warp of a steel plate 101 in accordance with the present invention is illustrated. The steel plate 101 has a reverse side or lower surface 101′ and an upper surface 101″. In its (+) warp, the lower surface 101′ is concavely arranged, as shown in solid lines, and in the (−) warp the upper surface 101″ is concavely arranged as shown in dotted lines. As shown in FIG. 1, the plate 101 is hung at the center of its L (length dimension) or it is made to stand on one of its edges which extend in the L direction. A desired cutting width "*b*" is selected extending from the upper edge of the plate and a string 103 is stretched between each of the positions A-A′, B-B′ . . . E-E′ and the maximum distance "*a*" is measured between the string and the adjacent surface of the plate. The maximum distance "*a*" between the string and the plate is defined as the L-warp of the plate, that is the warp in its length direction. The L or length direction is the rolling direction or the direction in which it is received as the strip is uncoiled from the hot rolled coil.

When cut plates are produced by gas cutting or shearing of the plate 101, the warp of such cut plates is measured in a way similar to that shown in FIG. 1. In this case, the width "*b*" is 150mm, L is 3m and the warp "*a*" is indicated in mm.

The reason for choosing the width of cut plates as 150mm is that cut plates of this width are most common in cutting practice, and that the degree of warp of cut plates of different width can be estimated from the degree of warp of the cut plate of 150mm width.

Under the above procedures for measuring warp, the cut plate can be regarded to have similar quality as conventional plate products, as far as the warp "*a*" is less than 20mm when the length L of the cut plate is 3m.

In the development of the present invention, it was appreciated that the degree of cold leveling given to the steel strip material uncoiled from a hot rolled steel coil is the surface strain of a steel strip and such strain is calculated as follows. As the strip material is leveled, its shape is assumed as a continuation of an arc and the center of the strip material in its longitudinal direction is regarded as a neutral axis where no expansion or contraction takes place. Therefore, the shape of the strip is considered to be a succession of circular arcs.

Figure 2:
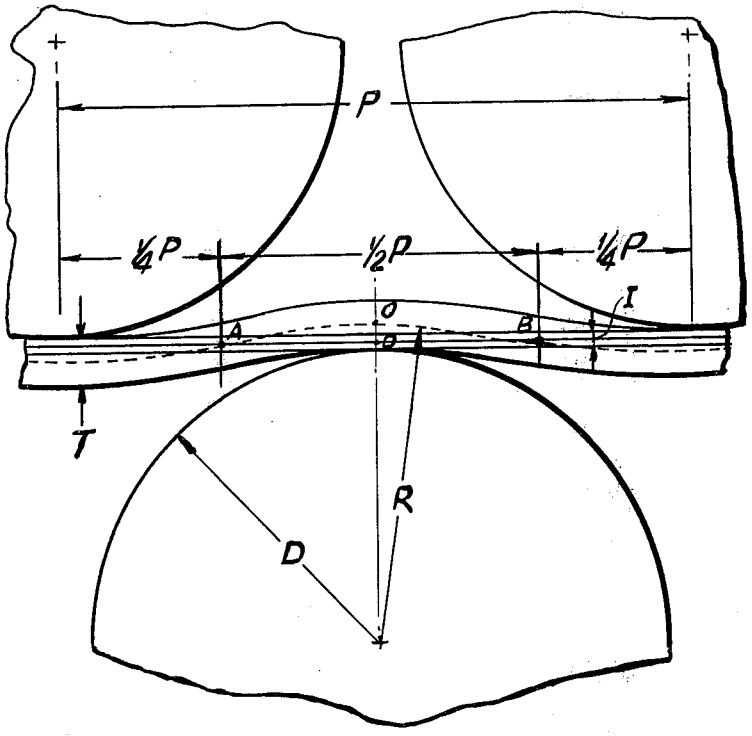
FIG. 2 is a schematic side view of the strip from a hot rolled coil passing between leveler rolls.

In view of the illustration in FIG. 2 showing strip material passing between the upper and lower rolls of a leveler, radius of curvature of the neutral axis R is calculated geometrically as in equation (1) below, and the surface strain $\epsilon$ of the steel plate is given by the equation (2).

$$\epsilon = T/2R \tag{2}$$

Note FIG. 2 in which T is the plate thickness and R is the radius of curvature of the neutral axis and I is the intermesh. Further, the dimensions used in equation 1 can be noted from FIG. 2 where the dimension P indicates the roll pitch of the rolls in the leveler. By substituting in equation (1) the surface strain $\epsilon$ is determined by the equation (2).

However, using this procedure the shortcoming has been noted that if the mill rigidity of the leveler is small, the actual surface strain ($\epsilon$) is smaller than the value calculated by equation (1):

$$R = AD^2 + DO^2/2\,DO$$

where: $AD = \frac{1}{4}P\ DO = T - I/2$ (1)

Accordingly, in the middle of the cold leveling procedure, the strip material was removed from the leveler and the actual residual curvature radius R′ was measured and the curvature radius R during the cold leveling was calculated as shown below taking into account the springback which occurred as determined by the residual curvature radius R′. When the curvature is three times or more of the elastic limit curvature, R can be approximated by the equation 3.

$$R_e/R - R_e/R' = 1.5 \tag{3}$$

or $$1/R_e = 2\epsilon_o/T \tag{4}$$

In these two equations, the following values are used.

$R_e$ = elastic limit curvature radius $R$ = curvature radius $R'$ = residual curvature radius
$\epsilon_o$ = elastic limit strain
$T$ = plate thickness From the equations (3), (4) the surface strain $\epsilon$ of a steel strip or plate is expressed by the equation 5.

$$\epsilon = T/2R' + 1.5\,\epsilon_o \quad (5)$$

As explained above while the degree of leveling is appreciated as the surface strain $\epsilon$ of the steel strip or plate, two methods are afforded for determining the surface strain, the method in equation (2) and that in equation (5).

As the difference between the two systems is, at most, 10% deviation as determined by the results of the two experimentations conducted by the inventors, either one of the equations may be used. However, in obtaining the degree of leveling from the intermesh in a geometric manner, as the surface strain depends on a leveling machine varies, the degree of leveling can not be properly evaluated. Accordingly, in developing the present invention, actual measurements of the residual curvature of the material passing through the leveler is measured in a precise manner and the surface strain $\epsilon$ of the steel plate is computed by equation (5).

It has been found by extensive experiment that the warp of a cut plate is less than 20 mm and no deterioration of mechanical properties is observed when the maximum surface strain (herein referred to as the surface strain $\epsilon$ max) of the steel plate lies within the range:

$$0.60\% \leqq \epsilon \max \leqq 3.0\%$$

The degree of leveling stress conventionally applied to a steel plate of large sizes (i.e. the sizes envisaged by the present invention) is such that:

$$\epsilon \max \leqq 0.50\%$$

According to the present invention the leveling force applied is such that $\epsilon$ max is between 0.60% and 3.0% as stated above. If $\epsilon$ max $<$ 0.60%, the warp of the cut plate is larger than 20 mm, while if $\epsilon > 3.0\%$ there are difficulties in the operation of the apparatus as, for example, in the biting angle of the leveler. Also, the mechanical properties of the resulting steel plate are less satisfactory.

Figure 3:
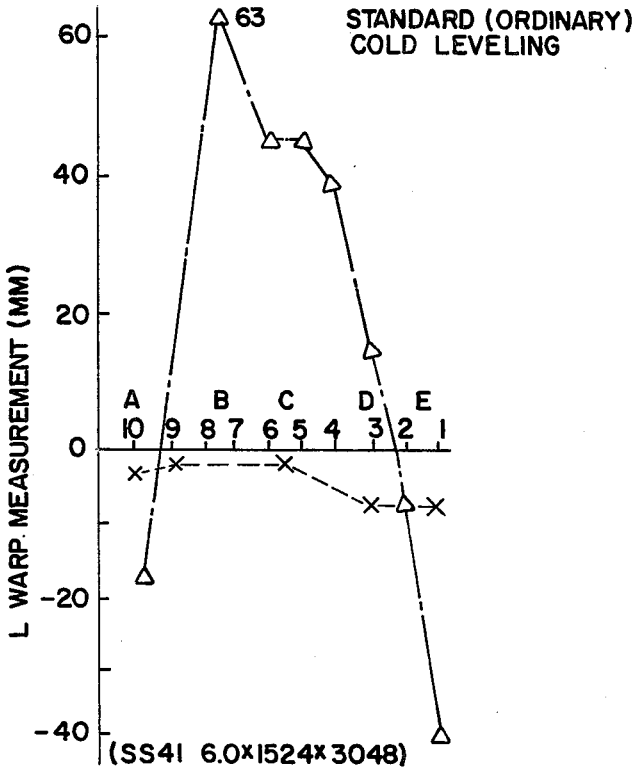
FIG. 3 is a diagram showing the measured values of the L warps (warps in longitudinal and rolling directions) of the original steel plate subjected to the standard cold leveling and cut plate (small plate cut from steel plate by gas cutting or the like called herein "cut plate")
Figure 4:
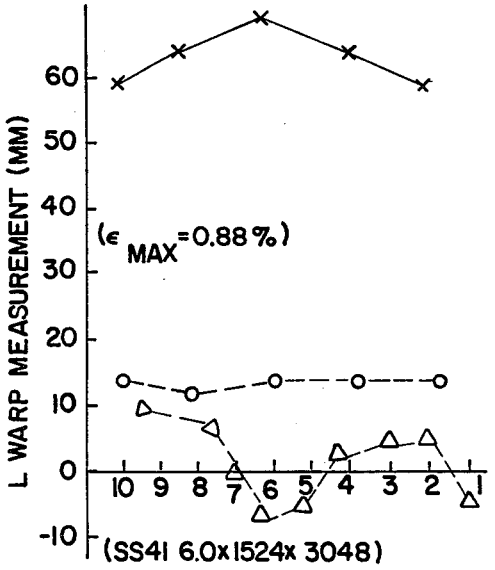
FIG. 4 is a diagram showing the measured values of L warps produced: in original steel plate subjected to light cold leveling; in steel plate subjected to the cold leveling according to the present invention; and in cut plate cut by gas cutting from said steel plate, respectively.

The secondary light leveling is performed from an $\epsilon$ less than 2.0% and near to the elastic limit strain. The above will now be explained in more detail. A hot rolled coil (SS 41) of 6.0 mm thickness is subjected to a conventional leveling (with cold rolling and leveling), and is then sheared to give a steel plate of length 3043 mm. The warp values (dotted line) along the lines passing the points A to E of the steel plate and the warp values (chained line) of gas cut plates are shown in FIG. 3. As shown, the warp values after gas cutting vary by more than 100 mm across the (+) and (−) zones. Cut plates of such warp values are not satisfactory. FIG. 4 shows warp values of a steel plate (dotted line) obtained from a similar coil to that referred to in the explanation of FIG. 3, but leveled so as to produce a surface strain $\epsilon$ max of 0.88%. The absolute warp values of these cut plates (chained line) are less than 20 mm and are within the scope of the present invention.

Figure 5:
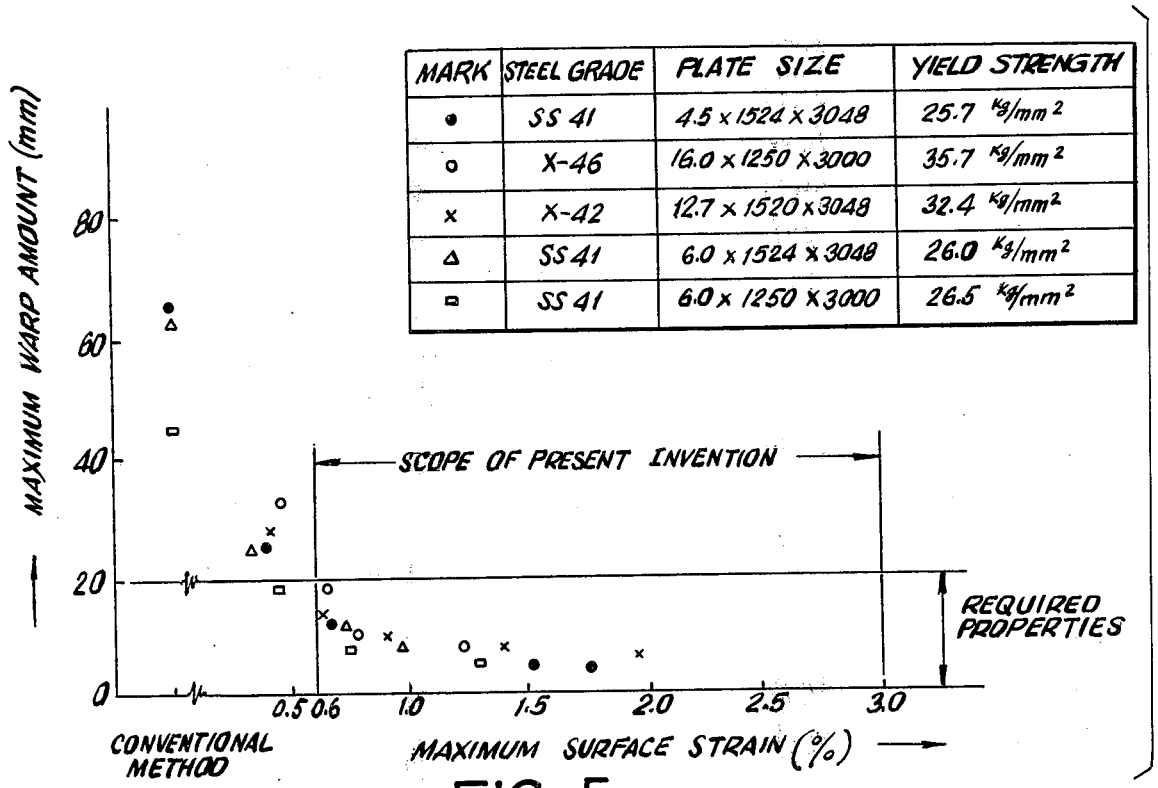
FIG. 5 is a graph indicating the relation between the maximum surface strain and the maximum amount of L-warp in cut plates obtained from a steel plate by gas cutting.

FIG. 5 shows the results of repeated experiments conducted with hot rolled steel coils of various plate thicknesses and material based on the relation between the maximum surface strain $\epsilon$ max of a steel strip, wherein the degree of leveling applied to a strip material from a coil by alternate bendings is appreciated as the maximum surface strain $\epsilon$ max, and the maximum L-warp of cut plates obtained a steel plate after gas cutting. Each example indicates that the amount of L-warp of cut plates can be held to 20mm or less by performing a strong cold leveling with a maximum surface strain of $\epsilon$ max $\geqq$ 0.60%, which on past experience has been considered not to be practical, thus it is considered necessary and indispensable for maintaining the L-warp within the given limits to afford a maximum surface strain $\epsilon$ max of $\epsilon$ max $\geqq$ 0.60% on the steel strip by a cold leveling. If the maximum surface strain $\epsilon$ max becomes higher than 3%, there will be difficulties in the mechanical limitations of the leveler such as in the biting angle, further the mechanical properties of the plate will deteriorate, accordingly, the upper limit of the maximum surface strain is maintained at 3.0%.

Figure 6:
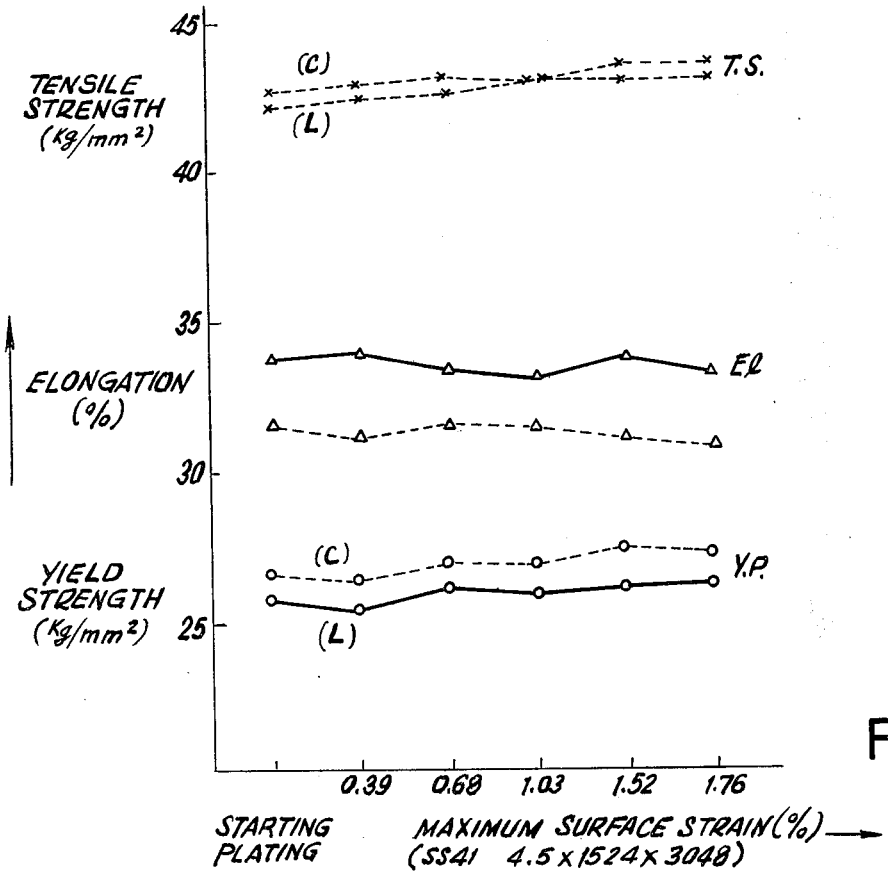
FIG. 6 is a graph exhibiting the relation between the maximum surface strain and mechanical properties of the plates.

In FIG. 6, examples are shown of the relation between the maximum surface strain of the steel plate and the yield point strength, the elongation and tensile strength, indicating that the mechanical properties which it was assumed from experience in the prior art would deteriorate after strong leveling, do not deteriorate. In this figure, the solid line shows the length direction (rolling direction) while the dotted line shows the C direction, that is, the direction transverse to the rolling direction.

Accordingly, by overcoming the erroneous concept concerning levelling as indicated above, it has been possible to achieve a method of producing steel plates from hot rolled coiled strip material in which the cut plates, after gas cutting or shear cutting, have an improved L-warp by strong cold leveling.

Further, the inventors have studied leveling processes both theoretically and experimentally and as a result have effected an economical and effective leveling process and apparatus for producing the steel plates from a hot coil.

That is, in the embodiment of the present invention, the number of rolls in the leveler must be considerably greater in the present invention than that in a conventional leveler. The need for such additional and larger equipment constitutes a problem in providing a practical structure for carrying out the leveling operation. However, after considering the problem, the present invention affords a reduction in the size of the equipment.

The leveling theories known to date, have been based on the assumption that the plate has a zero initial curvature, however, such theories could not be applied to strip material rolled in a coil shape which is the object of the present invention.

In the present invention, a new concept has been developed for producing plate from steel strip supplied in a coil shape having an initial curvature and according to the inventors' new theory, the distribution of residual stress within the steel plate generated due to the alternate elastic and plastic bending is calculated.

As explained further hereinafter, deformation curvature factor $K_i$ is defined as the degree of leveling working. Where $K_i = \epsilon i/\epsilon_o$, wherein $\epsilon_o$ is the elastic limit strain, $\epsilon i$ is the surface bending strain of $i^{th}$ roll ($= T/2R$), $K_o$ is the coil curvature factor (coil curvature/elastic limit curvature).

Figure 7A:
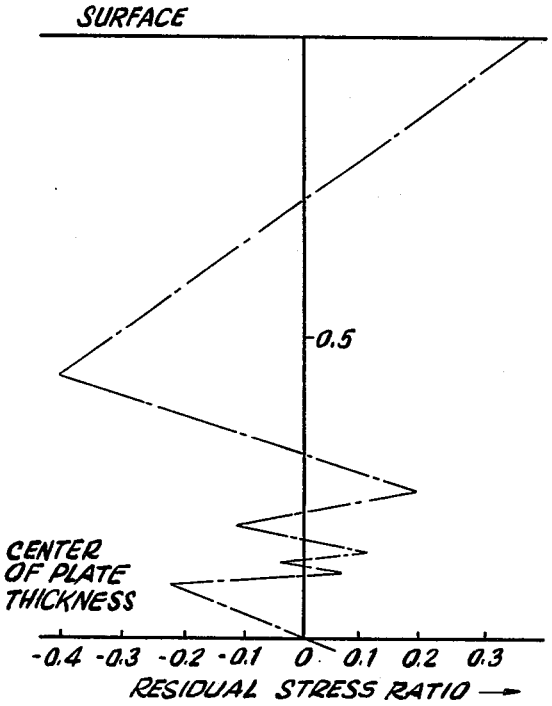
FIG. 7*a* is a graph illustrating the distribution of residual stress in the coiled strip when it is exposed to alternative bending in a cold leveler.

In FIG. 7a, an example of the residual stress within a plate produced in accordance with the new theory of the inventors is disclosed where seven alternative bending steps have been performed with the degree of leveling of the first bending operation being $K_1 = 9.8$ and the degree of working in the last bending step is $K_7 = 1.5$. This alternative bending action was applied to strip material from a hot rolled steel coil having an initial curvature factor of $K_o = 2.87$. The ordinate in FIG. 7*a* shows the plate thickness in which the center of the plate thickness of the strip material is taken as zero with its surface taken as 1, while abscissa shows the ratio of residual stress (residual stress divided by yield point stress) in the rolling direction.

Figure 7B:
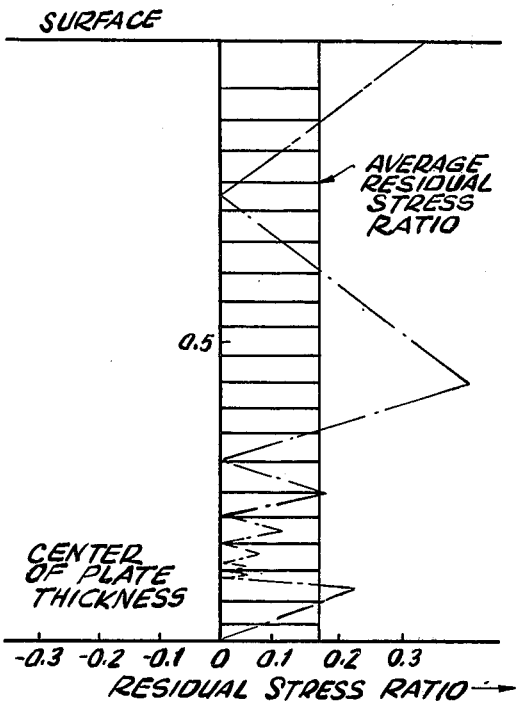
FIG. 7*b* is a graphic representation, similar to FIG. 7*a*, indicating the average residual stress ratio.

It has been found by many experiments that the L-warp and camber of cut plate can be redued by reducing the residual stress of the steel plate. The average residual stress ratio as shown in FIG. 7*b* which is the average of absolute value of the residual stress of the steel is introduced. That is, the smaller the average residual stress ratio, the smaller the L-warp and camber of cut plate.

While the degree of leveling in the disclosed example had a uniform graduation from $K_l$ to $K_n$ (hereinafter such graduation as having no variation from the beginning to the end in a course of gradual decrease of alternate bending amplitude will be called a uniform gradient, and the gradient having N times changes in the course of the working will be called an N-step gradient). If the beginning and the end degree of leveling are affixed while the gradient in the middle is changed in different ways, the residual stress also varies. For example, the results of the residual stress distribution in the case where three kinds of leveling processes (1) (2) and (3) are provided as shown in FIG. 8*a*, as calculated by the following principle taking the initial curvature factor at $K_o = 10$, are show in FIGS. 8*b*, 8*c* and 8*d*.

In FIG. 8*a*, an ordinary decrease of alternate bending amplitude is shown by (1) that is one with a uniform gradient connecting the maximum surface strain and the elastic limit strain of the steel, and its residual stress distribution is shown in FIG. 8*c*. As distinguished from the ordinary procedure, in (2) of FIG. 8*a*, an entirely unique leveling process according to the preferable method is utilized where the first half of the process has a gradual decrease with a sharper gradient than the uniform gradient of (1) in FIG. 8*a*, and the second half of the process has a gradient at an easier or less sharp slope than the uniform gradient. The residual stress distribution for the leveling process (2) as shown in FIG. 8*a* is indicated in FIG. 8*d* with the residual stress at the plate surface being finely divided and effectively reduced compared to the uniform distribution of FIG. 8*c* and its average residual strain ratio being smaller. On the other hand, if the leveling operation is carried out in accordance with the procedure of line (3) in FIG. 8*a*, the residual stress at the center of the plate will be small, but the residual stress at the plate surface will be very large and at the same time the average residual stress ratio will also become large.

Figure 9A:
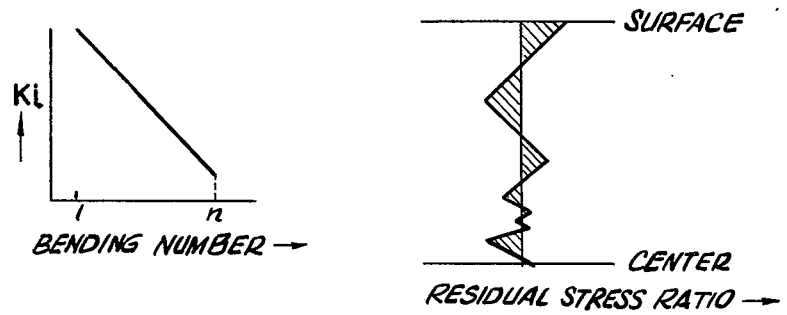
FIGS. 9*a*, 9*b* and 9*c* are graphs illustrating the relation between the leveling conditions and the distribution of residual stress within the material.
Figure 9B:
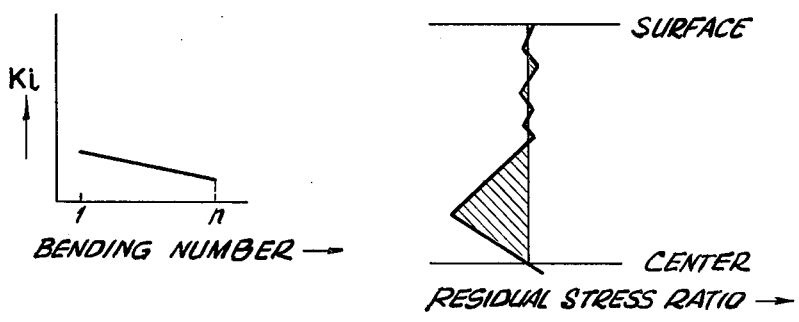
Figure 9C:
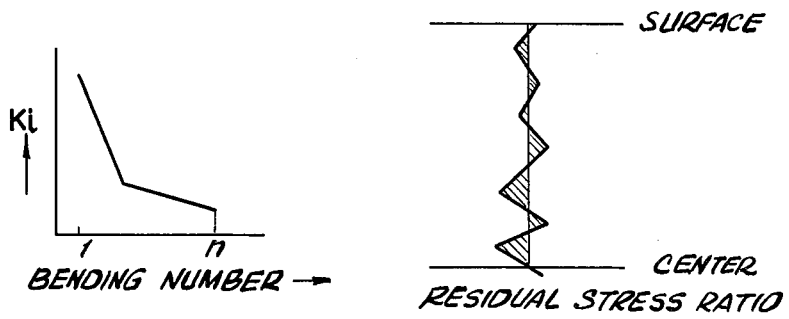

Based on the unique leveling process afforded by the present invention which is different from the conventional leveling used in the past, by providing a sharp decrease in the degree of leveling for the first part of the operation and then a slight or easy decrease for the second half of the leveling operation, as indicated by (2) in FIG. 8*a*, the average residual stress ratio will become smaller than the conventional uniform gradient known in the past. p In FIGS. 9*a*–9*c* the availability for the two-step gradient in leveling the strip material from a hot rolled coil based on the present invention is explained by model diagrams; in FIG. 9*a* only a strong cold leveling is performed on the strip material and serves to reduce the residual stress in the interior part of the plate thickness, however, it has little effect in reducing the residual stress in the surface portion of the material.

When only a light cold leveling is applied to the strip material, only the residual stress in the surface portion is reduced as shown in FIG. 9*b*.

However, where a two-step leveling operation is provided, that is, first a strong cold leveling followed by a light cold leveling; there is an optimum reduction of the residual stress and of the stress distribution pattern within the material as shown in FIG. 9*c*. Note in FIGS. 9*a*–9*c* that the right-hand graphical representation in each figure shows the distribution of the residual stress ratio.

Figure 10A:
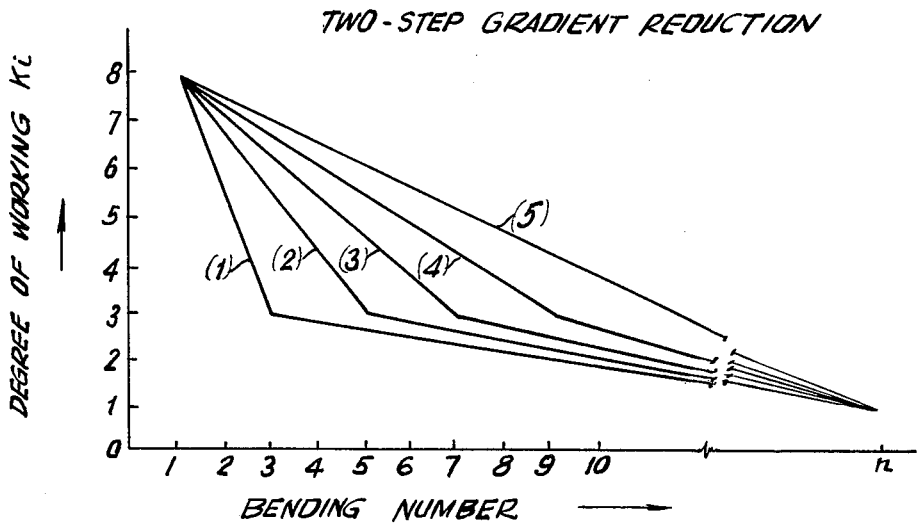
FIGS. 10*a* and 10*b* are graphs showing the relation between the leveling process and the average residual stress ratio for a two-step gradient reduction and a uniform gradient reduction.
Figure 10B:
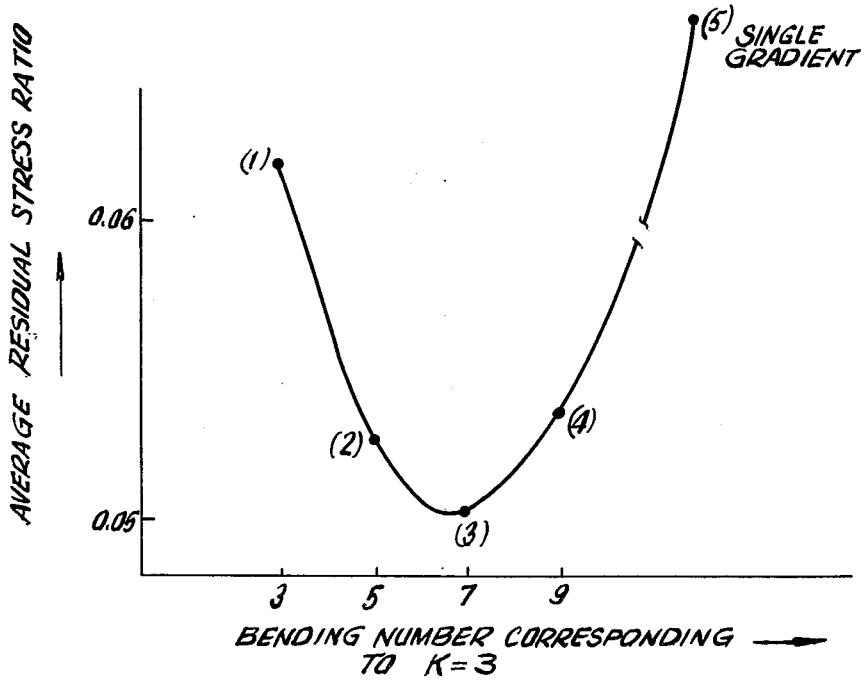

Referring to FIG. 10*a*, when the degree of leveling K at the point where the gradient changes in a two-step gradient reduction, is set at a predetermined value of 3, and as the slope of the first step of a strong leveling operation is reduced as shown by (1), (2), (3), (4), (5) of FIG. 10*a*, and the results of the calculations obtained from performing these various two-step gradient reductions are set forth in FIG. 8*b*. In FIGS. 10*a* and 10*b* (5) signifies a uniform gradient in the leveling operation and as can be seen in FIG. 10*b*, the average residual stress ratio is highest for (5) and is lower for each of the other two-step gradient to reduction operations. Further, considering the curve shown in FIG. 10*b*, it can be appreciated that there is an optimum condition in the two-step leveling operation which provides the minimum average residual stress ratio. The minimum mean value is 0.05 or less and is about 20% to 30% lower than that of the conventional uniform gradient reduction or leveling operation.

To lower the residual stress in the uniform gradient to the level of the optimum two-step leveling, it is necessary to provide about 1.6 times or more the number of bendings of the strip material compared with the two-step operation, as a result much larger equipment is required in case of the uniform gradient.

In the present invention, the leveling of the strip material does not prefer to follow the conventional uniform gradient reduction, but rather adopts a two-step gradient which decreases sharply in the first half of the leveling operation and then decreases in a much less sharp manner in the second half of the leveling operation as shown in FIG. 8*a* (2) so that the number of rolls is reduced. Furthermore, when gas cutting is used, the residual stress distribution in the plate thickness direction varies with the thermal energy, and in this case, the variation in the residual stress in the surface layer gives the greatest effect to the L-warp. Therefore, as compared to the uniform gradient, in case of the two-step gradient, the residual stress in the surface layer will be small, thereby significantly limiting the extent of the L-warp of cut plates.

So far as the initial successive diminution rate of the strong cold leveling and the terminal successive diminution rate of the light cold leveling meet the conditions as defined hereinabove, the intermediate successive diminution rate between the strong cold leveling and the light cold leveling may take any pattern.

In addition to the flatness of a cut plate in the leveling operation of the present invention, the flatness in the steel plate after leveling is naturally required and in the present invention, a plate with improved flatness characteristics is easily obtained compared to that obtained in the uniform gradient leveling method because the leveling is achieved by gradually decreasing the gradient of the leveling in the second half of the leveling operation.

Figure 14:
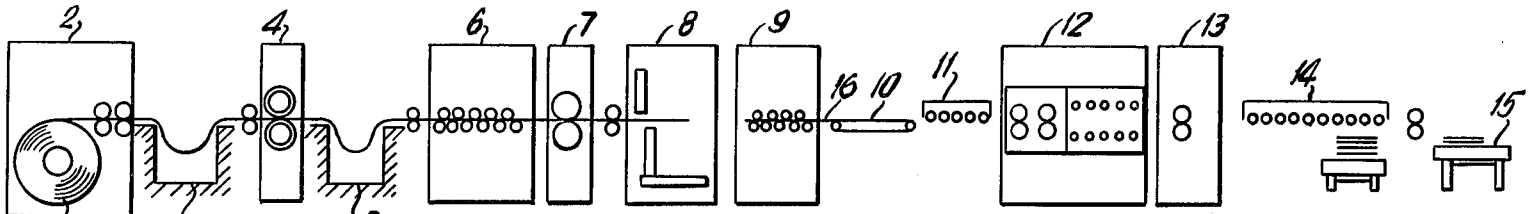
FIG. 14 is a schematic illustration of an apparatus embodying the present invention.

In the embodiment of our invention (as shown in FIG. 14), two stands of levelers are arranged; the first one 6 for a strong leveling and the second one 9 for a light leveling. A shear cutter is positioned between the first leveler 6 and the second leveler 9 and sheared plates are supplied to the second leveler 9. The reason for the arrangement is described below A. As the first leveler 6 is directed to give a strong leveling and the end portion of the plate is hard to be bitten, it may be necessary to loosen the bite angle to insert the end of the plate into the leveler and then to apply the desired strong leveling. When the plate is in the form of coil, the strong leveling can be continuously because only one end of the coil needs the above adjustment of bite angle, and thus a high productivity is assured.

B. When sheared plates eare subjected to the strong leveling, the above adjustment is necessary whenever a plate is inserted into the strong leveler. Nevertheless it causes remarkable slow-down of the line speed. Besides, not only the accuracy of sheared plates is lost because of expansion and contraction by a strong leveling, but also the leveler marking (Coarse Luders band) is found at the end portion of the plate.

C. On the other hand, the second leveler 9 gives a slight leveling and thus the above problems are not encountered even when sheared plate are leveled.

D. By introduction of the means of cutting between the strong leveler 6 and the light leveler 9, the shear-bow (warp of transverse direction) of the plate caused by shearing is corrected by a slight cold leveling after shearing.

E. The shape of a large-size strip is hard to be observed. But if it is sheared between two levelers, the shape can be confirmed and corrected by a slight cold leveling.

Figure 11A:
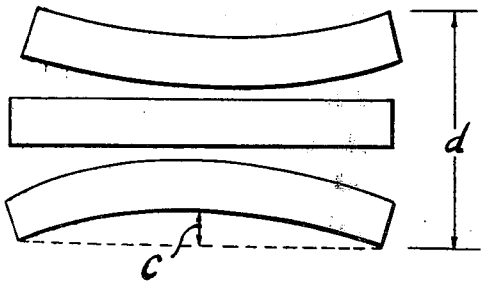
FIGS. 11*a* and *b* are schematic showings of the configuration of the cut plate when the steel plate is subjected to the slitting process, (a) showing the camber generated in case of the greater elongation existing at the center of the steel strip than that at the side end edge, while (b) shows the camber generated in case of the greater elongation existing at the side end edge of the steel strip than that at the center.
Figure 11B:
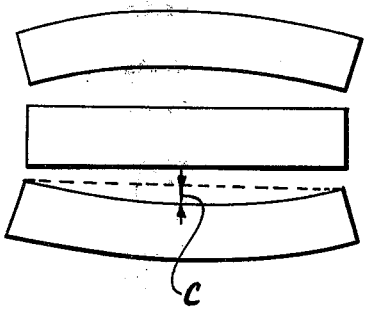

With respect to FIG. 11, when the distribution of the residual stress in the steel plate in the width direction is not uniform sufficiently, a camber "*c*" will be generated in cut plates as shown in FIGS. 11*a* and 11*b* when the steel plate is subjected to the slitting process.

This camber is strongly correlated to the configuration of the steel strip, and, in the case of a steel strip of the configuration having a greater wave in the center of the width thereof, a camber as shown in FIG. 11*a* tends to be generated, while in case of a steel strip of the configuration having a greater wave in the side end edge thereof, a camber as shown in FIG. 11*b* will be generated.

Such a camber tends to be made significant as the length of the steel plate is longer and the strength of the steel plate is higher.

If the camber is too great, troubles will occur in the succeeding working processes such as the press working, welding and the like.

With the length of the steel plate in the order of 10mm, the amount of the camber in excess of 3mm as shown in FIG. 11 will often cause troubles in the actual working processes.

The present inventors have carefully investigated the correlation of the configuration of the steel strip and the working condition of the levelers with respect to the camber of the cut plates after subjected to the slitting process and found out a method of preventing the generation of the camber.

Figure 12:
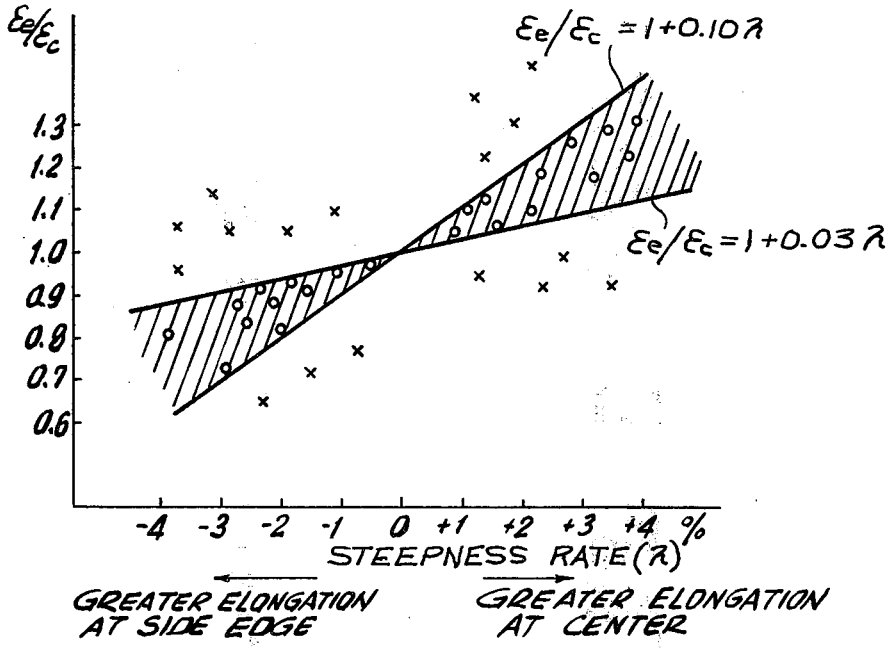
FIG. 12 is a diagram showing the relationship between the roll crown and the camber after subjected to the slitting operation of the steel plate.

The present inventors have examined the correlation of the camber of the cut plate after slitting process with respect to the roll crown of the roller leveler by using steel strip made of the material having Y.P. = 25 - 55 kg/mm$^2$ and having the thickness of 4.5 - 16mm and the width of 850 - 2180mm by varying the roll crown variously. The obtained plates are slit by shearing to a width of 250 mm ~ 300 mm. FIG. 12 shows the relationship between the leveling conditions and a maximum camber value of cut plates produced from a steel plate. As a result, it has been found out that the generation of the camber can be effectively avoided by selecting the working condition of the leveler within the range shown by hatching in FIG. 12. In the drawing, the small circle marks show that the camber is less than 3mm with respect to the length of the cut plate of 10m, while the small cross marks show that the camber is in excess of 3mm.

Figure 13:
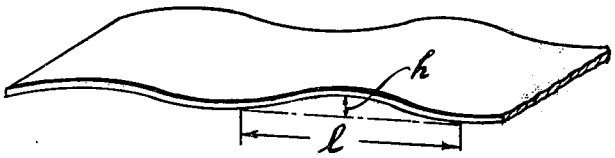
FIG. 13 is a perspective view giving the definition of the steepness rate of a steel strip.

Further, FIG. 13 shows the explanation of the definition of the steepness rate λ of a steel strip. As shown in FIG. 13, the steepness rate can be defined by;

$$\lambda = h/l \times 100(\%)$$

where; *h, l* given in FIG. 13.

In addition to the cold leveling performed by the apparatus of the present invention, the apparatus also preferably includes equipment for descaling treatment and rust preventative treatment and such procedure and equipment will now be explained.

The descaling equipment used in the present invention is preferably mechanical descaling devices of the dry type, such as a brushing device consisting of a brushing roll or wire, a grinder device, a shot blast device, or a sand blast device and such descaling equipment is located at the inlet end and the outlet end of the strong cold leveler or at either one of the inlet and outlet ends. However, since the strong cold leveler serves to break up the scale, it is most efficient to provide the descaling equipment at the outlet end of the strong cold leveler. In this case, descaling can be performed by a brushing roll which is a simple and economical piece of equipment. If descaling equipment is located at both the inlet end and the outlet end of the strong cold leveler, rough descaling of the strip material is done by the descaling device at the inlet end and there will be little likelihood of any flaws developing in the rolls of the leveler. Such an arrangement is advantageous from the standpoint of both productivity and quality. Moreover, a brushing roll can also be used at the inlet end, which, as mentioned above, is a simple and economical expedient.

Naturally, it is effective to provide a device for sucking off the scale removed from the strip material and to discharge the scale. Such equipment is located at the positions of the descaling devices.

Figure 16:
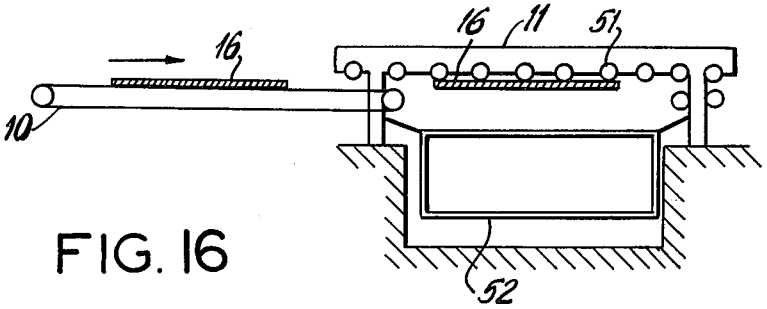
FIG. 16 is an enlarged showing of the tables 11 in FIG. 14 for inspecting the lower surfaces of a plate formed in accordance with the present invention.

Downstream from the leveling operation, a surface inspection table is used to inspect the plate for surface flaws, bends, flatness and the like and such inspection table is made as an ordinary plate-passing table. At the inspection table the lower surface flaws in the plate can be observed by utilizing a magnet roller and a mirror. Since, in the present invention, the steel strip is exposed to a considerably strong cold leveling in order to produce the steel plates equivalent to plate mill products, flaws in the leveler rolls are apt to develop in the upper and lower surfaces of the plate. Accordingly, an important element of the invention is the efficiency of the inspection which can appreciably enhance the productivity of the plate production. For example, a lower surface inspection table can be arranged to inspect the lower surface of a steel plate in a sure and safe continuous manner by the use of magnet rollers and a mirror as shown in FIG. 16. Such equipment is suitable for securing the quality of the product and for enhancing the productivity of the operation.

The application of the rust preventive layer in the present invention includes a coating device where spraying, dip coating, roller coating or brush coating is afforded and a drying device used after the coating operation is performed. The drying device may be combined with a plate preheating device which is positioned upstream from the coating operation. The rust preventative layer treatment can provide a nonelectrolytic or electrolytic rust preventative treatment such as a chromate treatment or phosphoric acid type treatment to the surfaces of the plate and form a continuous and uniform baked and hardened film. The most suitable composition of treatment liquid is an aqueous solution containing water soluble organic high polymer compound and is chiefly made of a water soluble chromium compound and has a considerably high viscosity.

An example of a water soluble organic high polymer compound is a polystyrene-maleic acid copolymer or polyvinylmethylethermaleic acid copolymer and more than one kind of such substances can be added in a weight percentage of 0.1 to 40. An example of the water soluble chromium compound is one containing at a maximum about 60% of ammonium chromate or ammonium dichromate and may be used ordinarily as an aqueous solution, if necessary, other additive element being mixed which do not impair the properties. It is desirable to use the rust preventative treatment liquid having a highly viscous liquid of at least 4.0 centi-poise or higher from a standpoint of affinity of the liquid and the plate. The pH of the chromate treatment liquid prefer to be 3.5 higher.

When the chromate treatment liquid is coated on the plate surfaces, preferably by a roller coating (for example, using felt coating rolls), a roller squeezes out the scale at uneven parts of the plate surfaces and effects the mixing of the treatment liquid and the scale with a high degree of efficiency. The excess treatment liquid on the plate surfaces is squeezed out by wringer rolls made from felt and overflow can be circulated through a filtration tank and, if necessary, a bar-shaped magnet with a very strong magnetism can be positioned within the filtration tank to remove fine particles of iron powder mixed in the liquid introduced into the tank.

The above mentioned specific chromate treatment is coated on a steel surface and the liquid is dried by heating. As a result, the film formed after heating can be a fine hardened film with a very good rust preventive effect and with very excellent coating adhering, adhesion workability, cover-coat accepting properties and a very satisfactory appearance. In the past an oil coating has been used as the rust preventive layer on hot rolled plate, however, when such an oil coating is used, it is difficult to provide clearly marked specifications, dimensions and the like on the steel plate surface. Further, the working efficiency of such plates is considerably lowered when the plates are welded or coated and as a result their use has a limited application. In the present invention the rust preventive film exhibits no similar difficulties as with an oil coating and can be used effectively in the welding, coating, and the like while having a good rust preventive effect. Further, plates coated in accordance with the present invention will have an excellent appearance particularly when combined with the descaling operation. Moreover, marking of the plate surfaces can be done in an easy and clear manner by a marking device described below.

In the present invention the marking device is used to mark specification, dimensions, delivery address and the like on the plate surface, and involves a printing system using a variety of means such as printing rolls, stencil spray system, punching system, label sticking system and the like. The printing system using printing rolls is the most desirable in view of its productivity, the economy in equipment and the simplicity of its operation.

In the printing system using printing rolls, various inks of either quick drying or slow drying types can be used, however, with quick drying inks there is the difficulty that as the ink dries its viscosity changes causing the letters marked to become obscure. If slow drying ink is used, there is a tendency for the marking to have blurred letters or for the letter markings to be reprinted as the plates are piled up. Therefore, slow drying ink of the oxidation polymerization type with a drying acceleration catalyst added is considered to be the most suitable.

After the plate surfaces have been inspected and printed with the markings, the plates are segregated in a product piling device while any rejected plates are directed to a reject take-out device. The piling device can, for example, employ a piler with a magnet roller. While the length of the plates is large, a piler with a magnet roller is most suitable since operation is easy for variation in the product length with high productivity and there is little likelihood of scratches being caused on the plate surfaces.

The reject take-out device can be any ordinary piler but preferably should be located behind the product piling device so that the operation area can be made smaller for allowing easier operation.

By the combination of the devices and equipment mentioned above, it is possible to produce on an industrial scale, in an economical efficient and continuous manner, thick hot rolled steel plate which is superior to the plate obtained in conventional plate mill. In accordance with the present invention, the steel plate produced will have no warp even when it is cut into cut plates and it will have no problems concerning rust formation and will have an attractively coated surface which permits clear marking of the plates.

In FIG. 14, the apparatus embodying the present invention is shown schematically. A hot rolled coil of strip material 1 is positioned in an uncoiler 2 and as it is removed from the uncoiler, passes successively through looping pits 3, 5, with a side trimmer 4 located between the looping pits. A strong cold leveler 6 receives the strip material from the looping pit 5 and brush rolls 7 for descaling is located at the downstream end of the strong cold leveler. From the descaling apparatus, the strip material passes through a cutting device 8 where selected plate lengths are separated from the strip material and the plates are then directed through a light cold leveler 9. With the leveling operation completed, the individual plates move over an upper surface inspection table 10 and a lower surface inspection table 11. After inspection, the plates are coated with a rust preventive layer in equipment 12 and then pass through a marking device 13 for applying the desired markings on the plate. Finally, the plates pass to a product piler 14, and, if necessary, are directed into a reject piler 15.

The hot rolled steel coil 1 (SS41, plate thickness 12mm, plate width 1250mm) is produced in a hot rolling mill and is unwound by the uncoiler 2 and passes through the side trimmer 4 after moving through the looping pit 3. In the side trimmer, both sides of the strip material are cut off by about 10mm to provide a uniform width of 1230mm. The looping pits 3 and 5 are loosening devices to prevent undue tension acting on the strip material as it moves through the side trimmer.

In the strong cold leveler 6, $\epsilon$ max = 1.4% of the steel strip surface strain is given under the optimum reduction standard (inlet intermesh 5.1 and outlet intermesh 10.5) experimentally obtained. The strip material moves through the brush rolls 7 for descaling and the rolls are shown schematically in FIG. 15.

Figure 15:
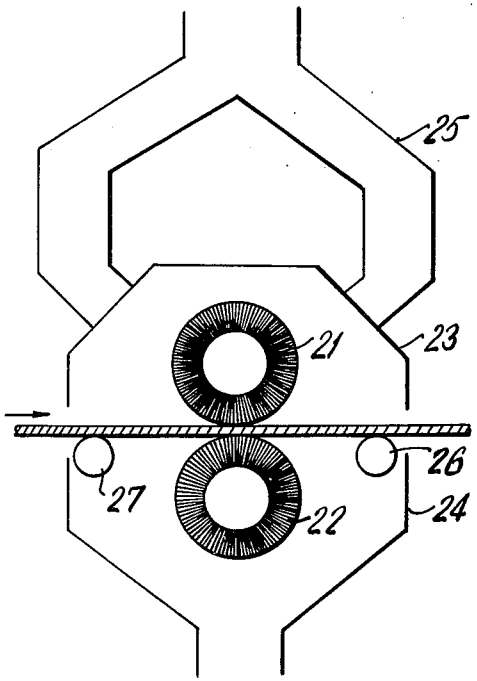
FIG. 15 is a schematic showing of a descaling treatment device 7 in FIG. 14 used in one embodiment of the present invention.

In FIG. 15, an upper brush roll 21 and a lower brush roll 22 are provided on the opposite sides of the plate surface and the rolls use stainless steel wire as the brush material. Dust preventive covers 23 and 24 are associated with each of the upper and lower brush rolls, respectively, for collecting any scale removed from the plate. Scale removed in the upward direction is drawn into a suction duct 25 for subsequent discharge. Any scale removed from the lower surface of the plate is directed into a scale ditch. Table rolls 26 and 27 are located on the opposite sides of the brush rolls. The surface scale which is partially crushed by the strong leveler 6 is removed by these brush rolls.

Next the material from the hot rolled coil passes through the cutting devices 8 and is divided into steel plates 16, 12.0mm in thickness, 1230mm in width, and 6000mm in length. The steel plates then pass through the light leveler 9 where the plates are subjected to light leveling in which the surface strain $\epsilon$ is below $\epsilon \leqq 0.4\%$ and diminished slowly by the light reduction of the inlet intermesh 10.3 and the outlet intermesh 11.6.

The steel plate flattened in accordance with the present invention is then directed over an upper surface inspection table 10 and a lower surface inspection table 11 which are shown in detail in FIG. 16. At the upper surface inspection table, a 100% inspection is made of surface flaws and shape and selected sample inspection is made on the plate thickness, plate width and length. At the lower surface inspection table, magnet rollers 51 are employed to carry the plate 16 over the table and any flaws in the lower surface of the plate can be easily observed by inspecting the reflection of the lower surface afforded by a mirror 52 located in the lower portion of this inspection site. Depending upon the inspection results, the plates are segregated into acceptable and rejected products. The accepted products are handled in the product piler 14 while the rejected products are directed to the reject piler 15.

Figure 17:
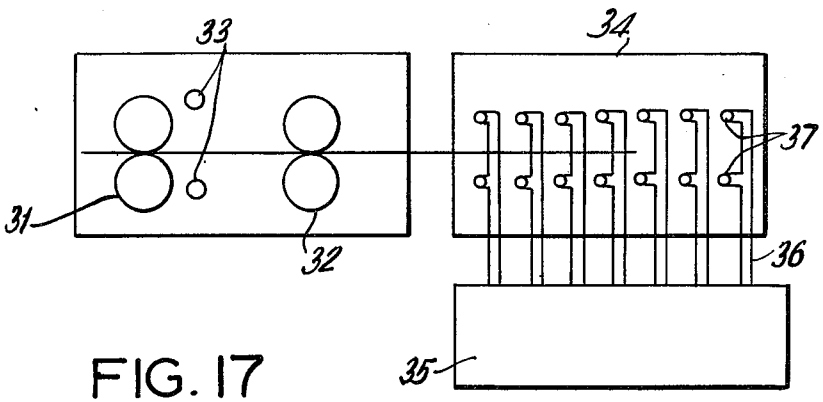
FIG. 17 is a schematic illustration of a rust preventative layer treatment device 12 in FIG. 14 utilized in one embodiment of the present invention.

Following the inspection, the plate moves through the rust preventive layer treatment device 12. This device is shown in FIG. 17 and includes felt coating rolls 31 to which the rust preventive liquid is supplied by headers 33 so that the liquid is coated onto the plate as it passes through the rolls. The rust preventive liquid is an aqueous chromate solution (viscosity 7.7 centipoise pH 7.0) with 3% ammonium chromate and a polystyrene maleic acid copolymer added thereto. Excess liquid is removed by the felt wringer rolls 32. Next the plate passes through a drying device 34 to which hot air at 200° C is supplied from a hot air generating device 35 through pipes 36 into pipe headers 37 within the drying device 34. The hot air is blown against the upper and lower surfaces of the plate to effect the drying. Next the coated plate 16 is moved to the marking device 13. In FIG. 18, the marking device is shown and ink is supplied from an ink spray nozzle 43 in a uniform manner between a rubber roll 41 and a steel roll 42 and from the rubber roll is transferred to a printing plate 44 mounted on a printing roll 40. The printing plate 44 marks the plate surface as the printing roll 40 rotates. In FIG. 19, an example of the plate marking is shown.

Next the coated and marked plate is directed into the product piler 14 as shown schematically in FIG. 20. Any plate rejected as a result of the inspection at tables 10 and 11 is directed into the reject piler 15. The plate piler is divided into three sections and has stoppers 60, 61 and 62, provided at each of the sections and magnet rollers are used for moving the plate between the different sections. When a plate length $l$ is $l \leqq L_1$, the stopper 60 is lowered to pile the plate on the No. 1 section, next the plate can be piled on the No. 2 section by lowering the stopper 61, and further the plate can be piled on the No. 3 section by lowering the stopper 62. Thus the piler is very efficiently used for short length plate. When the plate length $l$ is $L_1 < l \leqq L_1 + L_2$, the stopper 60 is lowered to pile the plate over the No. 1 and No. 2 section. Further, when the plate length $l$ is $L_1 + L_2 < l \leqq L_1 + L_2 + L_3$, the plate is piled over the No. 1 to No. 3 sections. The supporting stands 64 are made so that initially they are lowered from the position close to the magnet roller as the plate is piled so that the distance from the magnet roller and the upper surface of the pile of plates is kept constant to reduce any shock in the plates during the piling operation and, thereby, to prevent any development of surface flaws in the plate and also to limit the amount of noise generated in the piling operation.

By using the above described apparatus, the following advantages are obtained:

1. As the strong cold leveling is performed on the strip material, there is no danger of leveler mark formation and the biting-in angle is lessened as compared with the case of cut plates and thus the present invention is advantageous for producing thick plates without damaging the leveler rolls.
2. When strong cold leveling is performed after cutting, the steel plate is elongated or shortened irregularly and it is difficult to maintain any given size or to obtain good operation efficiency. These defects are eliminated in the present invention by carrying out at least the strong cold leveling before the strip material from the hot rolled coil is cut into plate lengths.
3. As the light leveling operation is performed after the strip material is cut into plate lengths, it is possible to correct the shape of the steel plates and a good flatness characteristic for the plates is easily obtained. Deformation of the steel plate resulting from shearing, for example, shear-bow, light leveler.
4. By providing a rust preventive coating on the plates after the completion of the leveling operation, the surface from which the scale has been removed during the leveling operation is completely protected by a chemical coating.
5. By positioning the marking device after the rust preventive treatment of the plates, good ink adhesion is assured and clear marking on the plate surface is obtained.

In the apparatus shown in FIG. 14, the scale removing device is located only at the outlet side of the strong leveler, however, a scale removing device can also be positioned at the inlet side for effectively protecting the leveler rolls from damage due to the scale. Further, as the scale is broken by the strong leveler, the scale removing effect of the descaling device at the outlet end is remarkably improved.

Further, with the descaling operation performed before the application of the rust preventive coating, the film formed in the rust preventive coating is uniform and an excellent surface appearance is obtained. Further, the improved surface provided on the plates assures improved marking capabilities and also enhances the commercial value of the plates.

With the plate surface inspection tables arranged downstream from the location of the leveling operations, it is easy to detect defects in the steel plate due to the leveler rolls because the rust preventive coating has been applied after the removal of the scale from the strip material.

When the upper surface inspection table and the lower surface inspection table are positioned behind or downstream from the strong leveler and the light leveler, there is the advantage that flaws caused by the leveling rolls can be easily detected since the plate has been descaled and the inspection is performed before the rust preventive treatment of the plates takes place.

The reject piler 15 is an ordinary piler, and by positioning it at the rear of the product piler 14, the size of the operating zone can be reduced thereby facilitating the operation. The L-warp value after gas cutting of the steel plate into cut plates will be lower than 10mm as shown in FIG. 21, the steel plate being cut in the rolling direction to divide the material into ten even parts ($b$ = 123mm, $L$ = 6000mm). The surface appearance of the plates formed will be better than plates formed in accordance with conventional plate mill products as shown in Table 1.

Table 1

| | Plate Mill Product (12.7 mm) | Hot rolled steel plate 12.7 mm | | |
|---|---|---|---|---|
| | | No. treatment | Chromate treatment | Descaling + chromate treatment |
| Surface appearance | B | C | B | A |
| % of brown rust formation | | | | |
| Exposure under eaves 4 days | 20 | 30 | 0 | 0 |
| Exposure under eaves 8 days | 20 | 50 | 0 | 0 |
| Exposure under eaves 12 days | 30 | 50 | 5 | 5 |
| Exposure under eaves 30 days | 40 | 100 | 40 | 35 |
| Indoor exposure 30 days | 10 | 10 | 0 | 0 |

The surface appearance is ranked in the order of A, B and C with A designating the optimum conditions with B and C in order indicating less effective conditions.

As has been mentioned before, while the material being processed is unwound directly from a hot rolled coil individual plates cut from such a coil could also be processed passing through both the strong and cold leveling operations in the cut condition.

Next, a concrete example of the present invention for preventing the generation of the camber will be described in detail.

The general arrangement of the apparatus for carrying out the manufacturing processes in this example was substantially similar to that as shown in FIG. 14. A coil of the steel strip made of the material having yield point of 40 kg/mm² and having the size 7.0mm × 1280mm was unwound in the uncoiler 2 and the width of the strip was reduced from 1280mm to 1260mm by the cutting operation of the side trimmer 4. The strip was then introduced into the strong heavy leveler 6 and, thence, to the running or flying shear 8 so as to be cut into the length of 10m, thereby producing steel plates having the size of 7.0 × 1260 × 10000mm. The steel plates were then passed through the light leveler 9 and loaded on a piler.

The working conditions of the heavy and light levelers were so set that the maximum surface strain $(\epsilon max)_c$ in the steel plate surface at the center thereof at the heavy leveler 6 was $(\epsilon max)_c$= 1.75% (actually measured value), while the maximum surface strain $\epsilon_c$ in the steel plate surface at the center thereof at the light leveler was $\epsilon_c$ = 0.5% (actually measured value).

In such manufacturing processes, the surface strain $\epsilon_e$ of the steel plate at the side end edge thereof was determined by moving back up rolls 8 – 12 of the heavy lever 6 as shown in FIG. 22 so that the clearance between the leveler rolls 13, 14 was varied in the width direction of the plate. In this example, the steepness rate $\lambda$ of the configuraion of the steel strip before it was introduced into the heavy leveler 6 was 1 – 1.5% wherein the wave at the center of the strip was greater than that at the side end edge.

By giving $\lambda$ = 1.5% and $\alpha$ = 0.1, the working condition was set from the preceding equation so as to obtain the value of 1.85% of $(\epsilon max)_e$.

Each of the three steel plates produced in the manner as described above are slit into five sections, respectively. The cambers of the cut plates are shown in FIG. 23. Each of the cambers is less than 3mm thereby affording superior results.

In this example, the roll crown of the heavy leveler was controlled. However, the same result can be obtained by controlling the roll crown of the light leveler. In this case, however, if too great roll crown is to be given to the light leveler, the configuration of the steel plate prior to slitting thereof will be deteriorated. Therefore, when the steepness rate of the steel strip is great, it is preferred to control the roll crown of the heavy leveler rather than the light leveler.

While specific embodiments of the invention have been shown and described in detail to illustrate the application of the inventive principles, it will be undestood that the invention may be embodied otherwise without departing from such principles.

What is claimed is:

1. A method for producing hot rolled steel plates, which are cut from a hot rolled steel coil having a thickness of not less than 4.5mm and substantially free from warp when cut into cut plates, comprising the steps of subjecting a steel strip obtained from the hot rolled steel coil to a cold roller leveling to give the steel a maximum surface strain $\epsilon$ max within the range of $0.60\% \leqq \epsilon \max \leqq 3.0\%$ for reducing the residual stress in the central portion of the steel, diminishing surface strain $\epsilon$ of the steel to the range of the elastic limit strain of the steel for reducing the residual stress in the surface portion of the steel, and cutting said steel strip subsequent to the step of giving said steel the maximum surface strain in order to produce said steel plates.

2. A method for producing hot rolled steel plates substantially free from warp when cut into cut plates cut from a hot rolled steel coil with not less than 4.5mm thickness, in which the steel strip obtained from the hot rolled steel coil is subjected to a primary strong cold roller leveling so as to give a maximum surface strain $\epsilon$ max within the range of $0.60\% \leqq \epsilon\max \leqq 3.0\%$ for reducing the residual stress in the central portion of the steel, and further subjected to a secondary cold roller leveling for reducing residual stress in the surface portion of the steel, said secondary light cold roller leveling being effected by diminishing the surface strain $\epsilon$ from the range of $\epsilon \leqq 2.0\%$ to the range of the elastic limit strain of the steel, and the steel strip is cut in order to produce steel plates between the primary strong cold roller leveling and the secondary cold roller leveling.

3. The method of producing hot rolled steel plates from a steel strip obtained from a hot rolled steel coil according to claim 2, further comprising the step of removing scale from said steel strip after the step of subjecting said steel to the primary strong cold roller leveling and before the step of subjecting said steel to the secondary light cold roller leveling.

4. The method of producing hot rolled steel plates cut from a hot rolled steel coil according to claim 2, further comprising the step of controlling the rolled crown of the primary strong cold roller leveling and/or of the secondary light cold roller leveling on the basis of the detected value of the steepness rate ($\lambda$) of the configuration of the steel strip so that the surface strain of the steel strip or plate at the side and edge thereof ($\epsilon_e$) and the surface strain of the steel strip or plate at the center thereof ($\epsilon_c$) satisfy the following equation $$\epsilon_e = \epsilon_c(1 + \alpha\lambda)$$

where, $\epsilon_e$ = surface strain (%) at the side and edge of the steel strip or plate;

$\epsilon_c$ = surface strain (%) at the center of the steel strip or plate $\alpha = 0.03 - 0.10$ $\lambda$ = steepness rate (%) of the configuration of the steel strip ( (−) sign of $\lambda$ in case of edge wave, (+) sign of $\lambda$ in case of center wave).

5. A method for producing hot rolled steel plates substantially free from warp when cut into cut plates which are cut from a hot rolled steel coil having a thickness of not less than 4.5mm, comprising subjecting a steel strip obtained from a hot rolled steel coil to a cold roller leveling in which, at least in the beginning stage of the cold roller leveling, the surface strain $\epsilon$ being sharply diminished after applying a maximum surface strain $\epsilon$ max within the range of $0.60\% \leqq \epsilon \max \leqq 3.0\%$ having a gradient steeper than a uniform gradient connecting the maximum surface strain $\epsilon$ max and the elastic limit strain of the steel, and, at least in the finishing stage of the cold roller leveling, slowly diminishing the surface strain $\epsilon$ to the range of the elastic limit strain of the steel with a gradient smaller than said uniform gradient, and cutting the steel strip in order to produce steel plates at least after subjecting the maximum surface strain $\epsilon$ max.

6. A method for producing hot rolled steel plates substantially free from warp when cut into cut plates which are cut from a hot rolled steel coil with not less than 4.5mm thickness, comprising the steps of subjecting a steel strip obtained from a hot rolled steel coil to a primary strong cold roller leveling in which a maximum surface strain $\epsilon$ max is effected within the range of $0.60\% \leqq \epsilon \max \leqq 3.0\%$ and the surface strain $\epsilon$ is sharply diminished with a gradient steeper than a uniform gradient connecting the maximum surface strain $\epsilon$ max and the elastic limit strain of the steel, further subjecting said steel to a secondary light cold roller leveling so that the surface strain $\epsilon$ is slowly diminished to the range of the elastic limit strain of the steel with a gradient smaller than said uniform gradient, and cutting the steel strip in order to produce steel plates between the primary strong cold roller leveling and the secondary cold roller leveling.

7. The method according to claim 6, in which said secondary light cold roller leveling reduces the surface strain $\epsilon$ from an initial surface strain of $\epsilon \leqq 2.0\%$ to the range of the elastic limit strain of the steel.

8. The method for producing hot rolled steel plates cut from a steel strip obtained from a hot rolled steel coil according to claim 6, further comprising the step of removing scale from said steel strip after the step of subjecting said steel to the primary strong cold roller leveling and before the step of subjecting said steel to the secondary light cold roller leveling.

9. The method for producing hot rolled steel plates cut from a hot rolled steel coil according to claim 6, further comprising the step of controlling the roll crown of the primary strong cold roller leveling and/or of the secondary light cold roller leveling on the basis of the detected value of the steepness rate ($\lambda$) of the configuration of the steel strip so that the surface strain of the steel strip or plate at the side and edge thereof ($\epsilon_e$) and the surface strain of the steel strip or plate at the center thereof ($\epsilon_c$) satisfy the following equation $$\epsilon_e = \epsilon_c(1 + \alpha\lambda)$$

where, $\epsilon_e$ = surface strain (%) at the side and edge of the steel strip or plate;

$\epsilon_c$ = surface strain (%) at the center of the steel strip or plate $\alpha = 0.03 - 0.10$ $\lambda$ = steepness rate (%) of the configuration of the steel strip ( (−) sign of $\lambda$ in case of edge wave, (+) sign of $\lambda$ in case of center wave).

10. A method for producing hot rolled steel plates substantially free from warp when cut into cut plates which are cut from a hot rolled steel coil having a thickness of not less than 4.5mm, comprising the steps of subjecting the steel strip obtained from the hot rolled steel coil to a primary strong cold roller leveling so as to give it a maximum surface strain $\epsilon$ max within the range of $0.60\% \leqq \epsilon \max \leqq 3.0\%$ for reducing the residual stress in the central portion of the steel, then cutting said steel strip into steel plates, and further subjecting said steel plates to a secondary cold roller leveling for reducing residual stress in the surface portion of the steel, said secondary light cold roller leveling being effected by diminishing the surface strain $\epsilon$ from the range of $\epsilon \leqq 2.0\%$ to the range of the elastic limit strain of the steel.

11. A method for producing hot rolled steel plates which are cut from a hot rolled steel coil with not less than 4.5mm thickness, and being substantially free from warp when cut into cut plates, comprising the steps of providing a maximum surface strain $\epsilon$ max within the range of $0.60\% \leqq \epsilon \max \leqq 3.0\%$ to the steel thus sharply diminishing the surface strain $\epsilon$ with a gradient steeper than a uniform gradient connecting the maximum surface strain $\epsilon$ max and the elastic limit strain of the steel by subjecting a steel strip obtained from a hot rolled steel coil to a primary strong cold leveling, and slowly diminishing the surface strain $\epsilon$ to the range of the elastic limit strain of the steel with a gradient smaller than said uniform gradient by subjecting said steel to a secondary light cold roller leveling, and cutting the steel strip between the primary strong cold roller leveling and the secondary cold roller leveling in order to produce cut steel plates.

12. An apparatus for producing hot rolled steel plates cut from a hot rolled steel coil having a thickness of not less than 4.5mm, comprising an uncoiler, a strong cold roller leveler for giving a maximunm surface strain $\epsilon$max within the range of $0.6\% \leqq \epsilon\max \leqq 3.0\%$ to said steel, a light cold roller leveler which is positioned subsequent to said strong cold roller leveler and capable of applying a smaller leveling force than that applied by said strong leveler, and means for shearing said steel which is positioned between said strong cold roller leveler and said light cold roller leveler.

13. The apparatus according to claim 12 in which the shearing means is a flying shear.

14. The apparatus according to claim 12, in which at least one of said strong cold leveler and said light leveler has roll-crown control means.

15. The apparatus according to claim 12, further comprising at least one inspection table located downstream from said light cold leveler for inspecting the front and back surfaces of steel plates, means for applying a rust preventive chemical treatment to said steel plates after the inspection, an in-line marking device, and a plate product piling device using magnet rollers.

16. An apparatus for producing hot rolled steel plates from steel strip obtained from a hot rolled steel coil having a thickness of not less than 4.5mm, comprising an uncoiler for unwinding said strip from said steel coil, a strong cold roller leveler for giving a maximum surface strain $\epsilon$max within the range of $0.6\% \leqq \epsilon \max \leqq 3.0\%$ to said steel strip, a flying shearing means positioned after said strong cold roller leveler, a light cold roller leveler being positioned subsequent to said shearing means and capable of applying a lesser leveling force than said strong leveler, an inspection table located downstream from said light cold leveler for inspecting the front and back surfaces of steel plates, means for applying a rust preventive chemical treatment to said steel plates after the inspection, an in-line marking device, and a plate product piling device using magnet rollers.

* * * * *